US011796251B2

(12) United States Patent
Tormo et al.

(10) Patent No.: US 11,796,251 B2
(45) Date of Patent: Oct. 24, 2023

(54) HEMP BIOMASS DRYING ASSEMBLY

(71) Applicant: THE SHIVVERS GROUP, INC., Corydon, IA (US)

(72) Inventors: Joaquin A. Tormo, Corydon, IA (US); Jose A. Andrade, Chariton, IA (US); Michael J. Schroeder, Humeston, IA (US)

(73) Assignee: The Shivvers Group, Inc., Corydon, IA (US)

( * ) Notice: Subject to any disclaimer, the term of this patent is extended or adjusted under 35 U.S.C. 154(b) by 0 days.

(21) Appl. No.: 17/113,742

(22) Filed: Dec. 7, 2020

(65) Prior Publication Data

US 2021/0172680 A1 Jun. 10, 2021

Related U.S. Application Data

(60) Provisional application No. 62/943,853, filed on Dec. 5, 2019.

(51) Int. Cl.

| | |
|---|---|
| ***F26B 11/14*** | (2006.01) |
| ***F26B 11/16*** | (2006.01) |
| ***F26B 25/12*** | (2006.01) |
| ***F26B 25/04*** | (2006.01) |

(52) U.S. Cl.

CPC ..... *F26B 11/14* (2013.01); *F26B 11/16* (2013.01); *F26B 25/04* (2013.01); *F26B 25/12* (2013.01); *F26B 2200/02* (2013.01)

(58) Field of Classification Search

CPC ..... F26B 11/14; F26B 11/16; F26B 25/04; F26B 25/12; F26B 2200/02; F26B 3/06; F26B 21/10; F26B 21/12; F26B 25/22; F26B 9/08; F26B 2200/06

USPC ..... 34/491, 493, 505

See application file for complete search history.

(56) References Cited

U.S. PATENT DOCUMENTS

| | | | | |
|---|---|---|---|---|
| 3,538,618 | A * | 11/1970 | Neuenschwander | F26B 9/082 34/102 |
| 4,773,808 | A * | 9/1988 | Fischer | B65G 65/365 414/302 |
| 4,930,229 | A * | 6/1990 | Moser | F26B 9/063 34/491 |
| 6,164,052 | A * | 12/2000 | Golay | A01D 84/00 56/366 |
| 6,203,261 | B1 * | 3/2001 | South | B65G 69/08 198/511 |
| 2020/0290826 | A1 * | 9/2020 | Gutwein | B65G 65/466 |

FOREIGN PATENT DOCUMENTS

| | | | | |
|---|---|---|---|---|
| DE | 202008014593 | U1 * | 2/2010 | A23B 9/08 |
| JP | H1045255 | A * | 2/1998 | |

OTHER PUBLICATIONS

English translation JP-H1045255-A (Year: 1998).*

* cited by examiner

*Primary Examiner* — Jessica Yuen
(74) *Attorney, Agent, or Firm* — ZarleyConley PLC

(57) ABSTRACT

A hemp biomass drying assembly that is disposed within a structure and having a central lift assembly, a rotatable tine assembly, an auger assembly, and a track drive assembly that are all connected to a control system to activate and operate all assemblies. The drying assembly has multiple modes of operation that include a spreading mode, a leveling mode, and stirring mode, and an unloading mode.

59 Claims, 7 Drawing Sheets

HEMP BIOMASS DRYING ASSEMBLY

CROSS REFERENCE TO RELATED APPLICATION

This application claims the benefit of U.S. Provisional Application No. 62/943,853, filed Dec. 5, 2019, the content of this application is hereby incorporated by reference in its entirety.

BACKGROUND OF THE INVENTION

The present invention is directed to a drying assembly, and more particularly a drying assembly for hemp biomass.

Interest in growing industrial hemp for CBD production has grown, particularly since hemp was legalized in the 2018 Farm Bill. Drying the hemp biomass once it has been harvested is an important step in the process. Hanging plants upside down on wires in a drying space such as a barn is one way of drying the plant. Unfortunately, as the plants dry the branches droop resulting in reduced air flow to the center of the hemp plants. As a result, mold and mildew tend to grow in the center portion. The damage can be reduced by breaking the branches off and hanging the individual branches, but the process is labor intensive. Also, this process requires approximately three days to dry the hemp in a drying space of between 800 to 2500 square feet.

Another method of drying hemp plants is to spread the plants across the floor of a structure. Not only does this practice require a good amount of space, but individuals often step on the plant packing the plant material together. Also, the process requires one to turn the plants repeatedly with a shovel which is time and labor intensive.

A still further method of drying hemp biomass material is through the use of a stirring device that pivots about a center of drying floor. A rotor, having fingers, rotates to fluff the hemp plant to provide greater air flow. While useful, existing stirring devices are driven with a peripheral drive wheel that does not provide good traction because the hemp plant is slippery and also the device has a single mode of operation with fingers that move in only a single direction.

Hemp has an oily, glue like component contained in the flower which is where desired chemicals are derived from. Based upon these characteristics it is challenging to move through the biomass as it is sticky and abrasive, and because of its molecular structure and high moisture content, hemp tends to stick together. When compressed, air will not flow through the bio-mass which is why stirring is needed. Also, because of the fiberous makeup of the hemp biomass material a conventional auger used for moving particulate and granular material is ineffective in transporting hemp biomass material for drying purposes.

Also, hemp is typically harvested wet and has a 60 to 70 percent moisture content. To efficiently dry the hemp plant, not only are multiple modes of operation needed to spread, level, and stir the plant material, but the process needs to be adaptable to various geographic locations where ambient conditions (i.e., Iowa versus Oregon, Georgia or Florida) are different. Accordingly there exists a need in the art for a hemp biomass drying assembly that addresses these needs and deficiencies in the prior art.

An objective of the present invention is to provide a hemp biomass drying assembly that reduces the drying time of hemp.

Another objective of the present invention is to provide a hemp biomass drying assembly that is less labor intensive and more economical to use.

A still further objective of the present invention is to provide a hemp biomass drying assembly that has multiple modes of operation.

These and other objectives will be apparent to those having ordinary skill in the art based upon the following written description, drawings and claims.

SUMMARY OF THE INVENTION

A hemp biomass drying assembly disposed within a structure having a bottom wall and a side wall. The drying assembly includes a lift assembly disposed within the center of the structure. Connected to the lift assembly is a rotatable tine assembly and an auger assembly that extend radially from the center of the structure. The rotatable tine assembly and the auger assembly have multiple modes of operation that include a spreading mode, a leveling mode, a stirring mode, and an unloading mode. Attached to the auger assembly is an auger lift assembly that adjusts the angle of penetration between auger and the biomass and raises and lowers the auger assembly.

Disposed within the structure is a drying floor that separates the structure into a drying area above the drying floor and a drying air plenum between the drying floor and the bottom wall of the structure. Connected to the structure and in fluid communication with the drying air plenum is a drying system. The drying system includes at least one fan and at least one heater/burner that are connected to a control system that activates and controls the air flow and temperature of the drying system.

The auger assembly includes an auger and an adjustable backboard while the rotatable tine assembly includes a radial shaft, a mounting tube connected about the shaft, and a plurality of tines connected to the mounting tube. Connected to both the rotatable tine assembly and the auger assembly is a tractor drive assembly adapted to rotate both the rotatable tine assembly and the auger assembly about the center of the structure.

Connected to the lift assembly, the track drive assembly, the rotatable drive assembly, the auger assembly, and the auger lift assembly is a control system that activates and controls the operation for each of the multiple modes of operations.

DETAILED DESCRIPTION OF THE PREFERRED EMBODIMENTS

Figure 1:
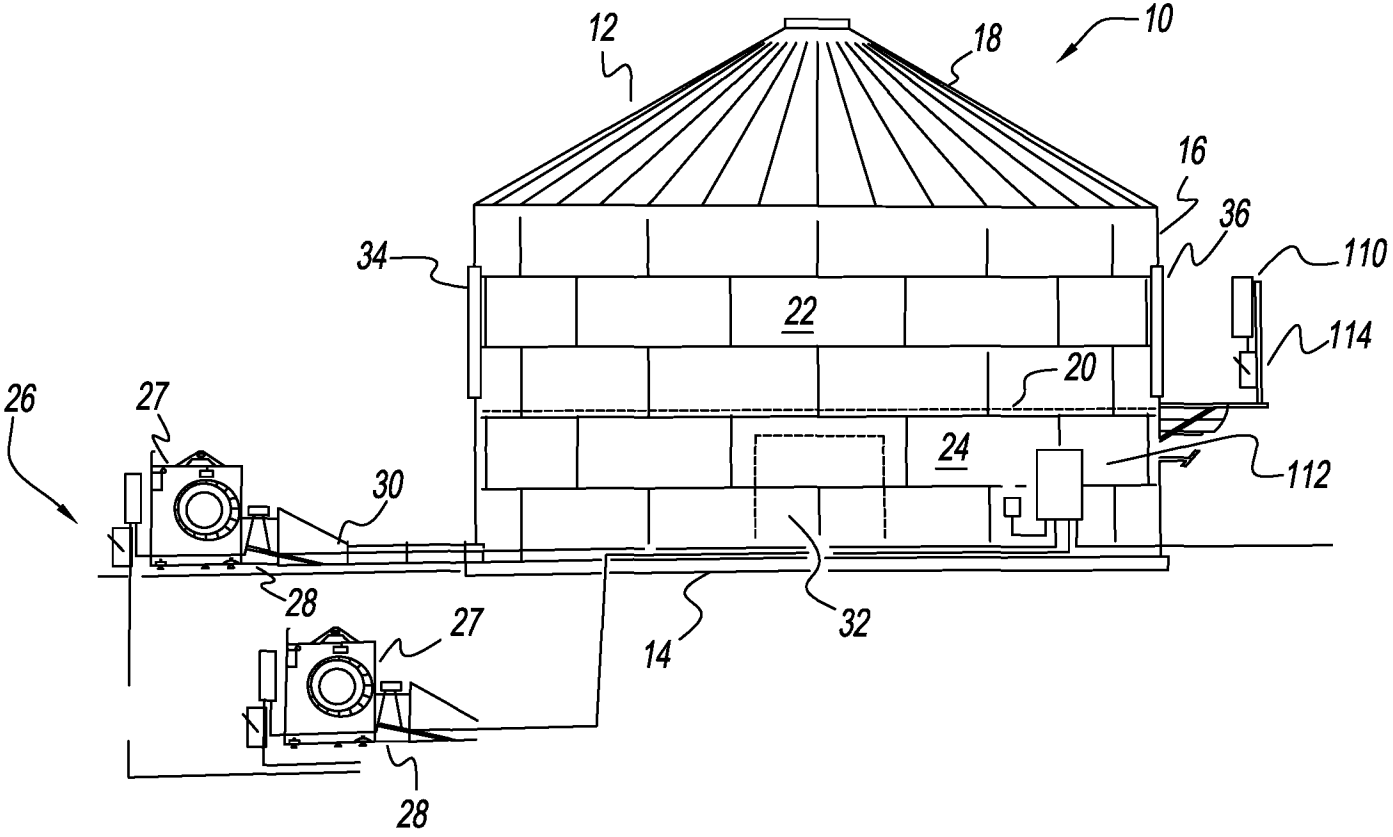
FIG. 1 is a side view of a drying system and a structure.
Figure 2:
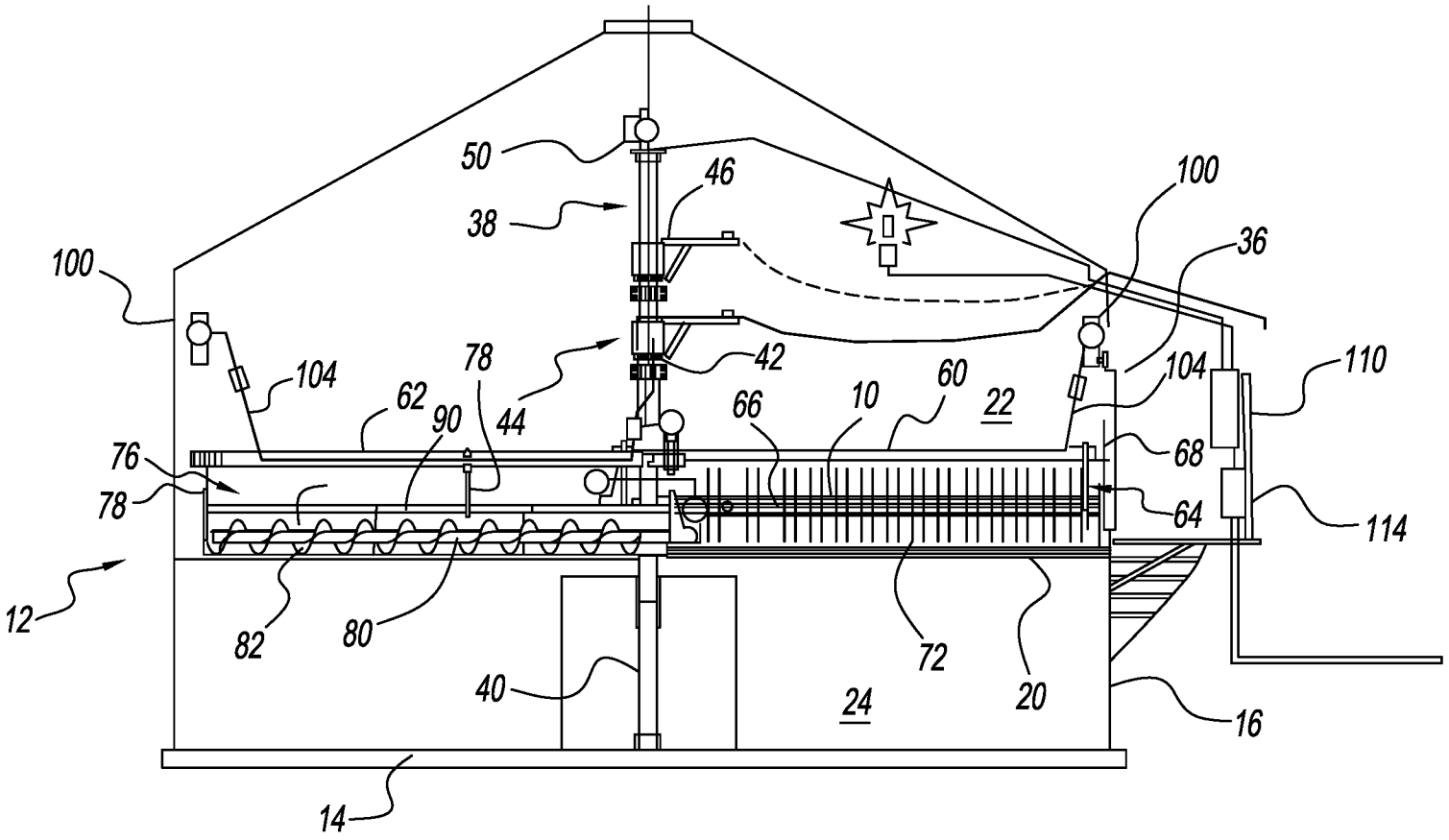
FIG. 2 is a side sectional view of a drying assembly.
Figure 3:
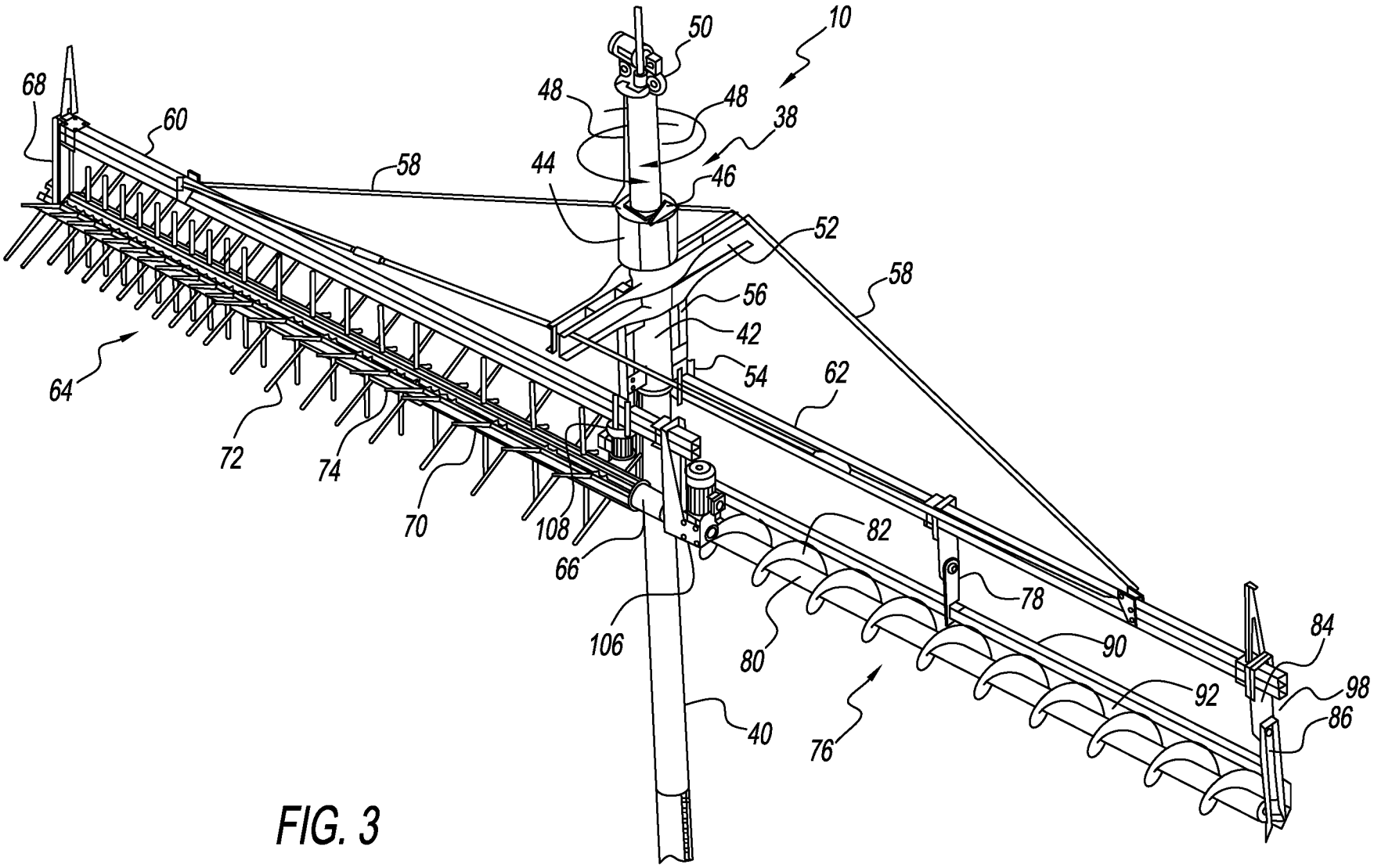
FIG. 3 is a perspective view of a drying assembly.
Figure 4:
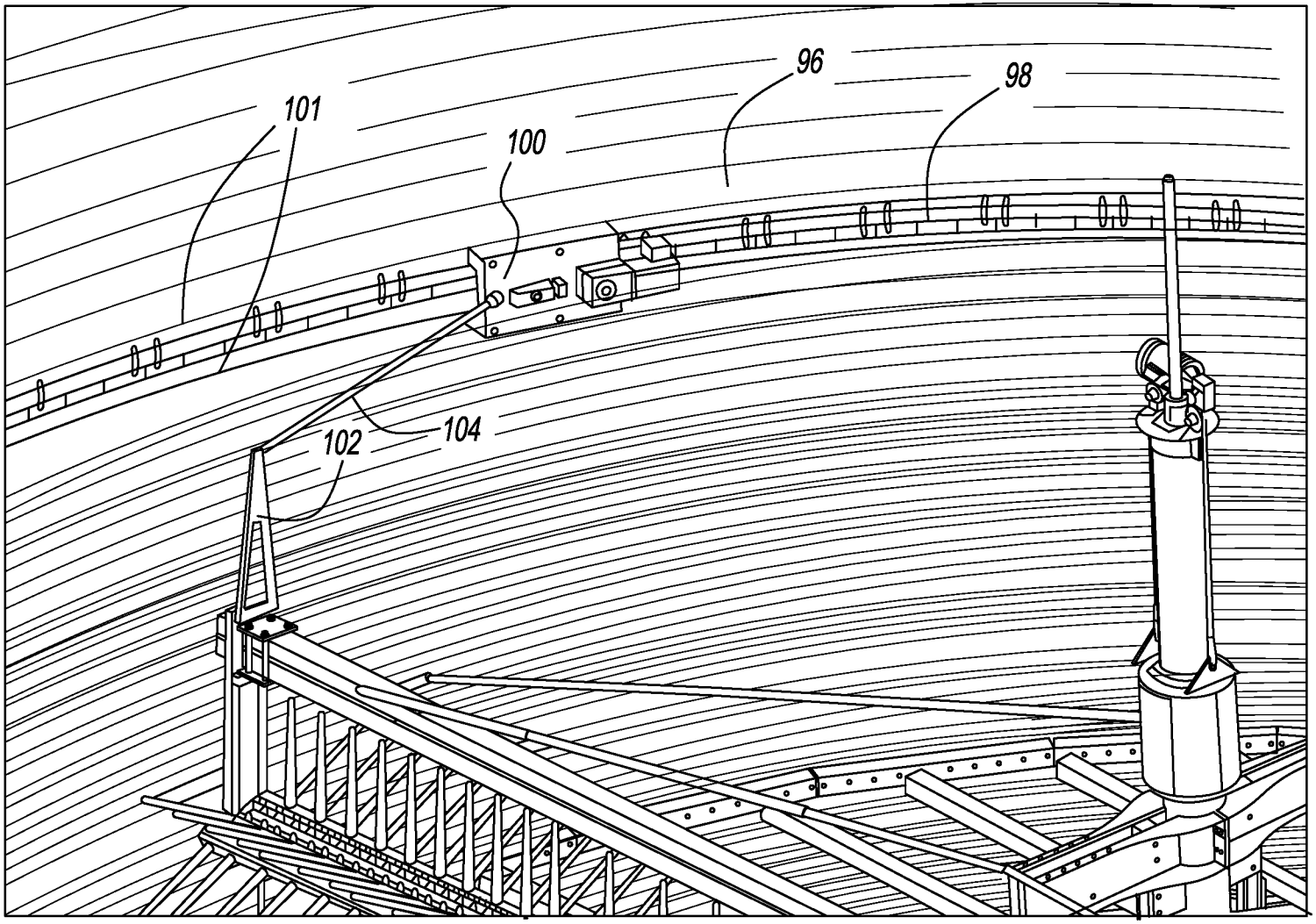
FIG. 4 is a perspective view a drying assembly.
Figure 5:
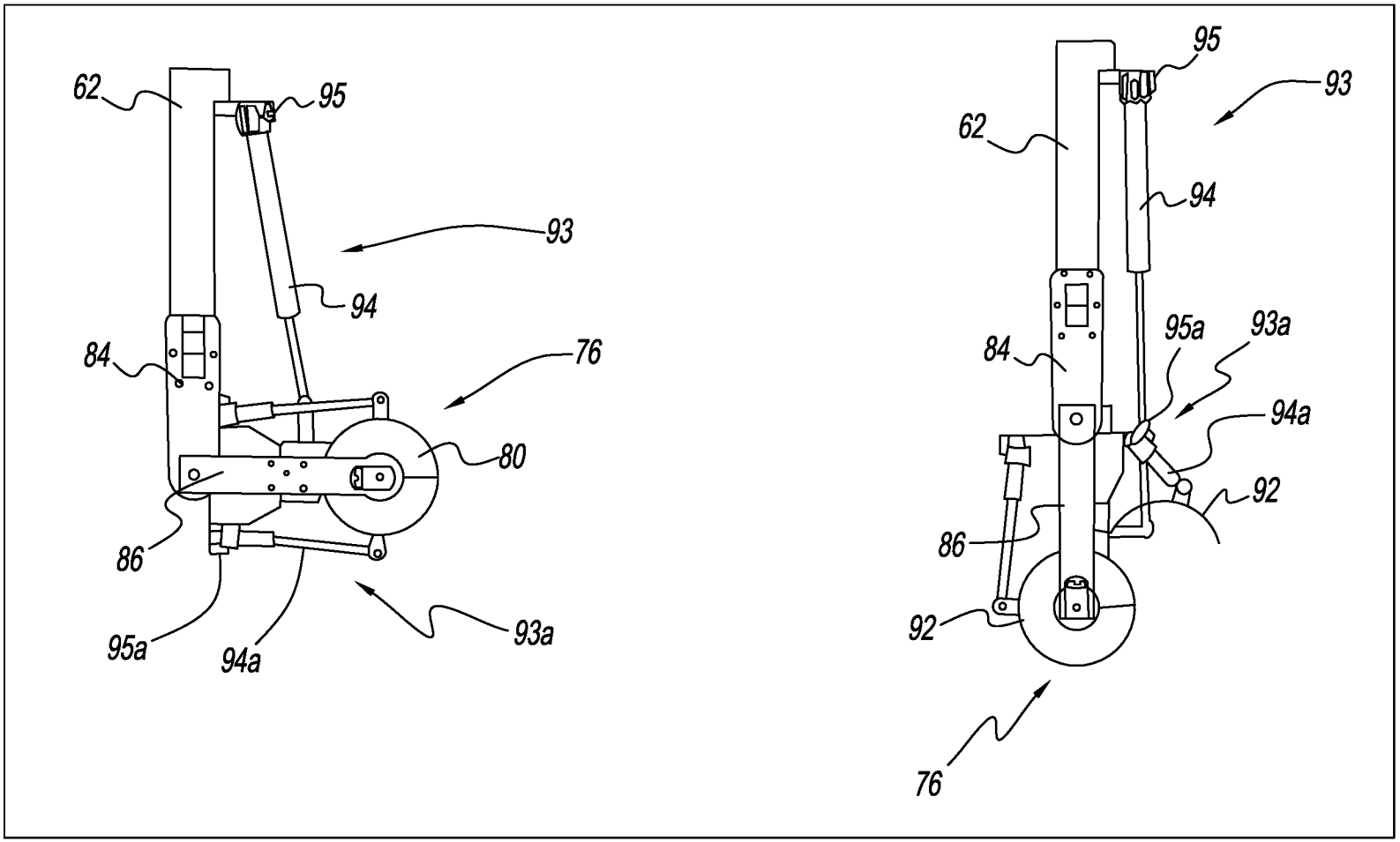
FIG. 5 is a side view of an auger lift system.
Figure 6:
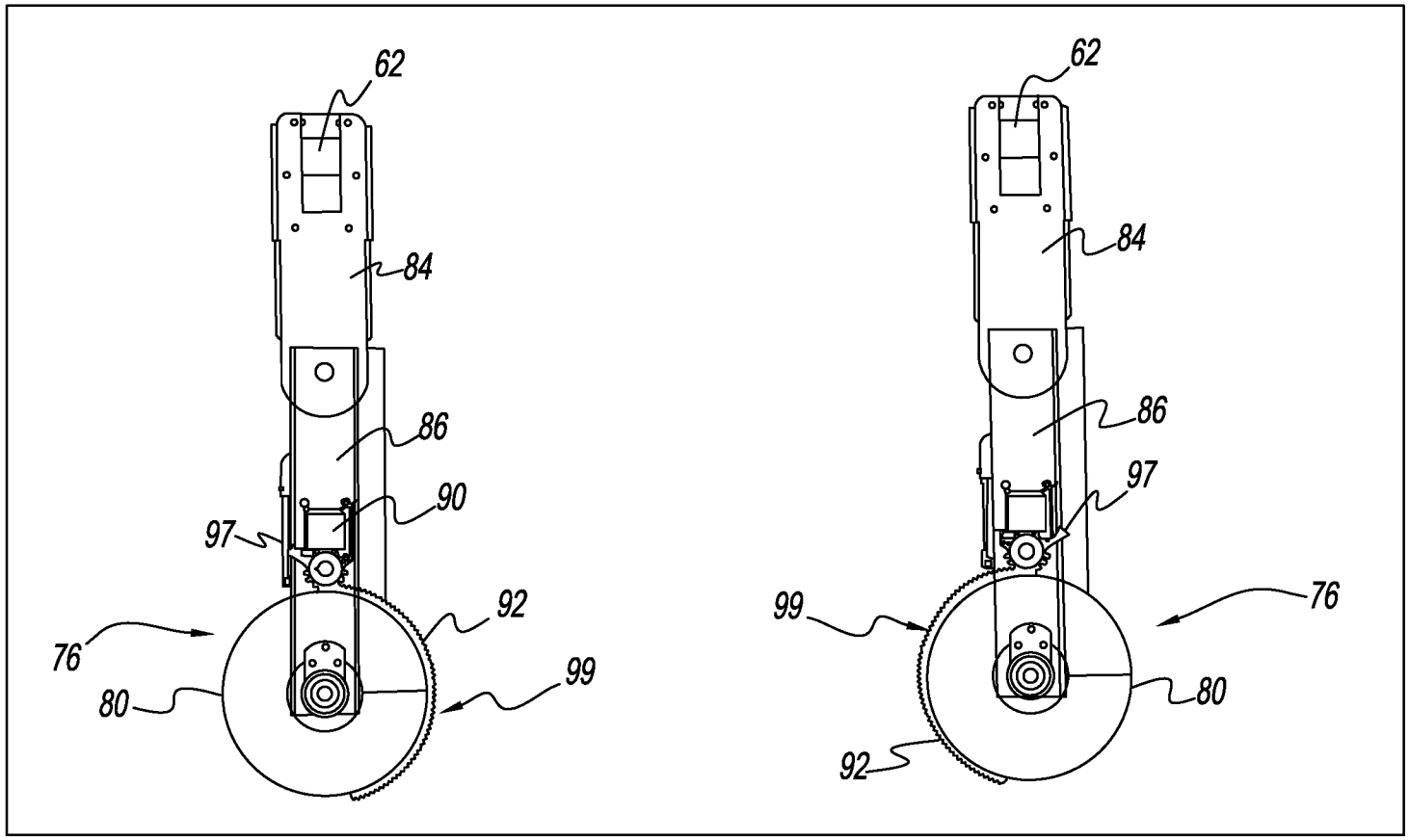
FIG. 6 is a side view of an auger assembly.
Figure 7:
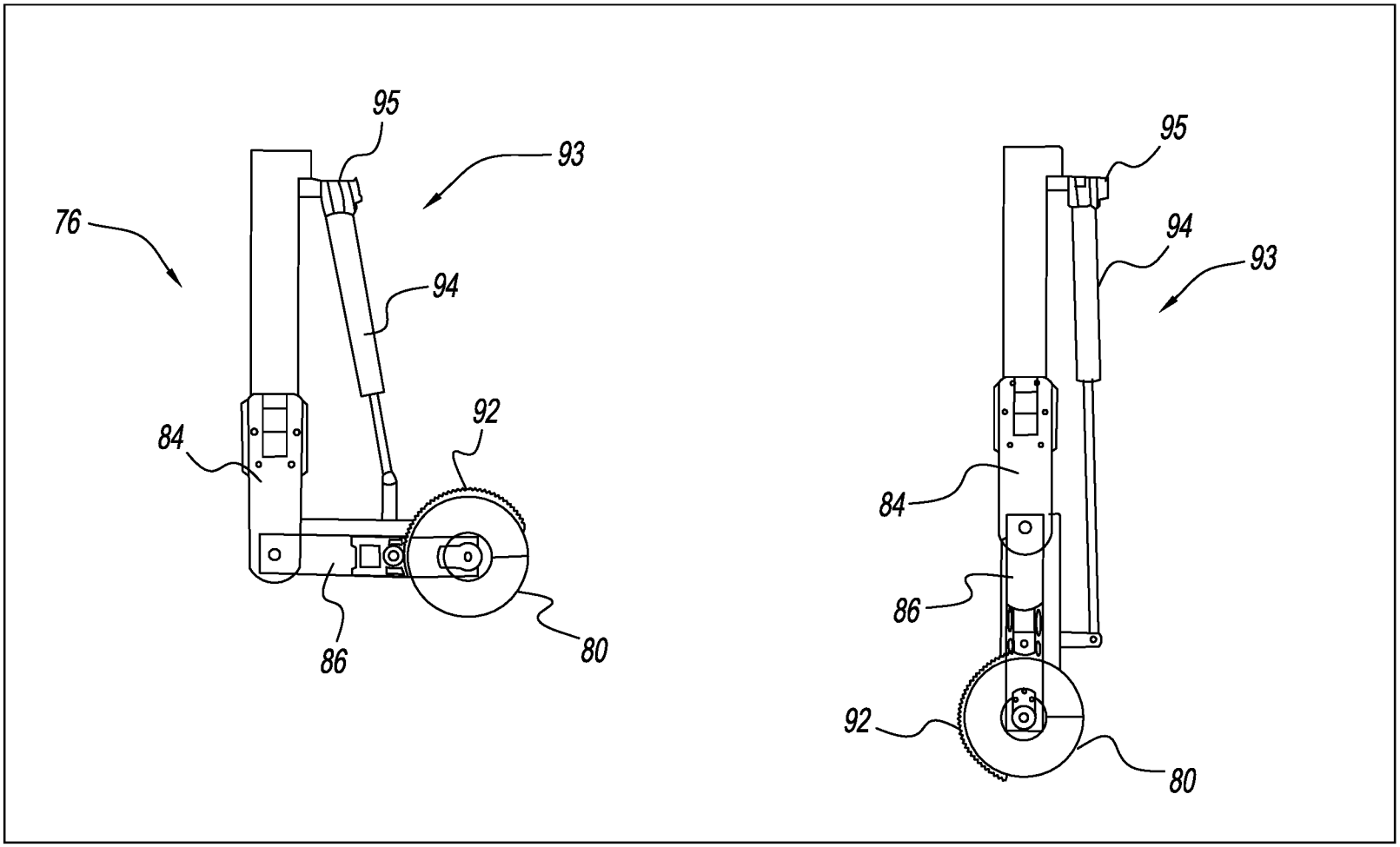
FIG. 7 is a side view of an auger assembly.

Referring to the Figures, a hemp biomass drying assembly 10 is used in relation to a structure or housing 12 having any size, shape or structure and in the example shown is circular. The housing 12 has a bottom wall 14 and a side wall 16, with a roof or cover 18 being attached to a top edge of the side wall 16 which is optional. Disposed within the structure 12, in parallel spaced relation to the bottom wall 14, is an elevated perforated plenum drying floor 20 which separates the interior of the structure into a plant drying area 22 above the drying floor 20, and a heated air plenum 24 between the drying floor 20 and the bottom wall 14. The drying floor 20 preferably is made of steel and holds the biomass material while having small holes or perforations to permit air flow.

Connected to the side wall, and in communication with the heated air plenum 24, is a drying system 26. The drying system is of any type, structure or combination that provides drying air of any combination of temperatures and humidity to the air plenum and in the example shown, the drying system 26 includes a centrifugal or axial fan 27 that is used to supply the drying assembly 10 with drying air, and a heater/burner 28 used to raise the temperature of the drying air, that are connected to an air duct 30 that supplies heated air to the heated air plenum 24. The heater/burner 28 are fueled by propane, natural gas, or an alternative fuel source. Multiple fans 27 and heaters/burners 28 can be added to the drying system 26 depending upon the drying capacity needed. The side wall 16 of the structure 12 has an unloading door 32 to the heated air plenum 24 positioned below the drying floor 20, a biomass loading door 34 to the drying area 22 above the drying floor 20, and an access door 36 to the drying area 22 above the drying floor 20.

Disposed in the center of the structure 12 is a center mast tube lift assembly 38. The lift assembly is of any shape, structure or size. In the example shown, the lift assembly 38 has a first tube 40 that is connected to the bottom wall 14 and extends vertically through the drying floor 20 and into the plant drying area 22. Slidably and rotatably mounted about the first tube 40 is a second tube 42. At a top end of the second tube 42, electrical slip rings 44 are mounted about the second tube 42, and a bracket 46 is connected to both the second tube 42 and the electrical slip rings 44. The electrical slip ring assembly is connected to and provides power for various motors, sensors and/or other electrical devices within the drying assembly. A pair of cables 48 are connected to the bracket 46 and extend vertically to a first motor 50 that is positioned at a top end of the first tube 40. The first motor 50 is of any type, but preferably is a jack screw lift.

Also attached to the second tube 42, below the electrical slip rings 44 is an elongated horizontal support member 52 and below the horizontal support member 52 and attached to the second tube is a support bar bracket 54. A pair of vertical support members 56 are connected to and extend between the horizontal support member 52 and the support bar bracket. Connected to the horizontal support member, at each end, are a pair of support rods 58 that extend downwardly and outwardly at an angle where they are connected to a tine support bar 60 and an auger support bar 62. Adjacent inner ends of the tine support bar 60 and the auger support bar 62, the vertical support members 56 of the support bar bracket 54 are connected.

A rotatable tine assembly 64 is connected to the tine support bar 60 by a vertical support member 68 at each end of the tine support bar 60. The rotatable tine assembly 64 is of any size, shape and structure. In one example, the rotatable tine assembly 64 has a radial shaft 66 which extends from the center of the structure 12 to adjacent the side wall 16. The radial shaft 66 is rotatably connected to the vertical support members 68 at each end. Connected to and around the radial shaft 66 is a mounting tube 70 to which a plurality of tines 72 are mounted. The mounting tube 70 has a plurality of holes 74 that receive the tines 72 and the holes are positioned along the mounting tube 70 in spaced relation in horizontal rows. Preferably, the holes are offset from the holes of an adjacent row. While tines 70 are shown, other devices such as paddles or the like may be used instead.

An auger assembly 76 is connected to the auger support bar 62 by a plurality of vertical support members 78 with at least one at each end of the auger support bar 62. The auger assembly 76 includes an auger 80 having flighting 82 that is rotatably connected to the vertical support members 78 at each end. The vertical members 78 have a first piece 84 that is connected to the auger support bar 62 and a second piece 86 that is pivotally connected to the first piece 84. The auger 80 is rotatably connected to the second piece 86 of the vertical support 78. Connected to and extending between the second piece 86 of the vertical supports 78, above the auger 80, is a backboard support member 90. A backboard 92 is attached to the backboard support member 90 and is positioned to cover a portion of the auger 80 along the length of the auger 80. The backboard 92 provides a physical barrier that prevents the biomass from being transferred to the opposite side of the auger 80. The backboard 92 also directs the conveyance of the biomass material to be parallel with the length of the auger 80. Also connected to the second piece 86 of the vertical support member 78 on the inner end of the auger assembly 76 is an auger lifting assembly 93. In one example the auger lifting assembly includes a piston 94 that extends vertically to a second motor 95. The second motor 95 is attached to a vertical support member 56 of the lift assembly 38. The auger lifting assembly provides the ability to raise or lower the auger assembly 76 to adjust the angle and depth of engagement that the auger 80 has with the biomass during the various modes of operation or to lift the auger assembly 76 out of engagement with the biomass. In manual operation the auger assembly 76 is raised or lowered with a toggle switch (not shown).

In one embodiment, the auger assembly 76 has a pair of backboards 92 connected to a pair of backboard lifting devices 93A. Each backboard lift assembly 93A includes a piston 94A and an actuator 95A such as a motor, pneumatic drive, or the like. The pistons 94A are pivotally connected to the backboard 92 at on end and to a bracket 97 at the opposite end. The bracket 97 is connected to the second piece 86. The actuators 95A are connected to and controlled by the control system 110. Depending which direction the auger assembly is travelling across the drying floor 20 the backboard lifting device 93A on the front or forward side of the auger assembly 76 is activated so that the piston 94A contracts raising the backboard 92 on the forward side while the backboard 92 on the reward or trailing side remains in place.

In yet another embodiment the backboard 92 is adjustable about the auger 80 based upon the direction of travel of the auger assembly 76. To adjust the backboard 92 a rotational member 97 such as a sprocket with teeth is positioned above the backboard 92 and engages grooves 99 on the outer surface of the backboard 92. The rotational member is mounted to the second piece 86 of the vertical support member 78. Once activated by a control system 110 the rotatable member 97 rotates causing the backboard to rotate about the auger 80 to be positioned on the back side of the auger 80 and opposite the direction of travel of the auger assembly 76.

A track assembly 96 is used to rotate the drying assembly 10 about the first tube 40 positioned in the center of the structure 12. The track assembly includes a chain track 98 connected to an inner surface of the side wall 16 preferably in a plane above the tine support bar 60 and the auger support bar 62 and extends along the inside perimeter of the side wall 16 of the structure 12. Preferably, the chain track 98 has a pair of spaced rails 101 that reduces the chance of derailment. Moveably attached to the chain track 98 are a pair of tractor drive assemblies 100 positioned 180 degrees in relation to the other. Brackets 102 are attached to the outer ends of both the tine support bar 60 and the auger support bar 62 and towing rods 104 are pivotally connected to and extend between the brackets 102 and the tractors 100. The tractor drive assemblies 100 travel along the chain track 98 on the inside perimeter of the side wall 16 of the structure 12 to rotate the tine assembly 64 and the auger assembly 76 about the first tube 40 within the structure 12.

Connected to an inner end of the rotatable tine assembly 64 is a third motor 106 that drives the rotation and direction of the tine assembly 64 and attached to the inner end of the auger assembly 76 is a fourth motor 108 that drives the rotation and direction of the auger 80. The third motor 106 and fourth motor 108 are connected to a control system 110 that is adapted to control, either manually or automatically, the rotational speeds and direction of rotation of the tine assembly 64 and the auger assembly 76 respectively. The control system 110 preferably is equipped with switches, multiple speed drive, variable speed drive, and/or Variable Frequency Drives or the like to operate and control the drying assembly 10 including the rotation, speed, travel direction, raising/lifting and lowering of various components of the drying system 10. In one example, the control system 110 is positioned adjacent the access door 36.

The fan 27 and heater/burner 28 are connected to a second control system 112 that is adapted to manually or automatically control the temperature and the flow rate of the air that flows through the air duct 30 to dry the biomass. Also, a plurality of sensors or monitors 114 are positioned both within the structure 12 and outside the structure that measure air temperature, humidity, and biomass moisture. As one example, sensors 114 are positioned to measure the temperature and humidity of the saturated air exiting the biomass layer. Temperature and humidity will vary based on the incoming moisture content of the biomass, the desired final moisture content of the biomass, and the ambient conditions. The sensors 114 are connected to both the first and second control systems 110 and 112. There is also a safety control panel 113 with safety switches that are used for safe operation of the drying assembly 10.

Positioned below the drying floor 20 and connected about the first tube 40 is a discharge hopper 116. A pair of discharge flaps 118 are positioned above the discharge hopper 116 and selectively open and close an opening 120 in the drying floor 20. The discharge flaps 118 are flush with the drying floor 20. Connected to the discharge flaps 118 is an activator 122 that moves the flaps 118 between an open and closed position. The activator 122 is connected to the control system 110 or it can be manually operated. Biomass storage sacks (not shown) are positioned under the discharge hopper 116 or alternatively a conveyor (not shown) is positioned under the discharge hopper to collect and convey dried biomass from the structure 12.

In operation, wet biomass is positioned inside the structure 12 on the drying floor 20. In one example, wet biomass is transported into the structure via a portable conveyor and deposited on the drying floor 20. The drop point of the biomass material may be at the center of the structure 12, at the outer perimeter of the structure 12, or somewhere in between. The drying system 10 is then activated using both control systems 110 and 112. The tractor drive assembly 100, which is connected to the control system 110, once activated begins to move along the chain track 98 in a first, or forward direction. As the tractor 100 moves forward, the tow rod 104 follows, which causes the tine assembly 64 and the auger assembly 76 to rotate about the center of the structure 12. Both the speed of rotation about the center of the structure and the direction of movement, forward or backward, are adjustable by the control system 110. The fan 27 and heater/burner 28 are also activated by the control system 112. Based upon information provided by the sensors 114 the control system adjusts the temperature and air flow based upon the incoming moisture content of the biomass and the desired ending moisture content of the biomass, along with conditions inside the structure and ambient conditions outside the structure, and determines when to adjust the temperature, adjust the air flow, switch off the burner, and when to stop the drying operation.

In a first mode, or spreading mode, of operation, the drying assembly 10 is positioned to engage the biomass material by activating the first motor 50 to lower the lift assembly 38 so that the drying assembly engages and spreads the biomass material from the drop point inside the biomass loading door 34 to cover the entire drying floor 20. In the spreading mode, the control system 110 activates the tractor drive assembly 100 to move the tine assembly 64 and auger assembly 76 about the structure 12 in a first or forward direction. The control system 110 also activates the third motor 106 causing the tine assembly 64 to rotate in a counter or backward direction where the tines 72 engage the biomass to move the biomass forward in front of the shaft 66 (or the direction the tine assembly 64 is moving) while the tines move up and over the shaft 66. The auger assembly 76 also is activated by the control system 110, through the activation of the fourth motor 108, to engage the biomass. The direction of rotation of the auger 80 is determined by the position of the biomass. To move the biomass inward toward the center of the structure 12 the auger 80 is rotated in a counter or backward direction where the biomass is moved forward in front of the auger 80 while the auger continues to rotate upward and over toward the backboard 92. To move the biomass outward toward the side wall 16 and outer perimeter of the structure 12, the auger is rotated in a concurrent or forward direction where the biomass is moved backward of the auger 80 toward the backboard 92 as the auger rotates downward and then toward the backboard. While the tine assembly 64 is not necessary in the spreading mode, the use of the tine assembly accelerates the spreading process.

Once the biomass material is spread across the drying floor, in a second mode of operation, the biomass material is levelled to enhance uniform drying through the biomass layer. Using the control system 110, the first motor 50 is activated so that the lift assembly 38 positions the tine assembly 64 and auger assembly 76 so that the tines 72 are partially inserted into the biomass material. Once positioned, the control system 110 activates the third motor 106 to rotate the tine assembly 64 and the second motor 95 to lift the auger assembly 76 to a raised position where the auger does not engage the biomass material. Finally, the control system 110 activates the tractor drive assembly 100 to rotate the drying assembly 10 about the first tube 40 in a forward direction. This produces a "rolling wave" of biomass ahead of the shaft 66 which fills in the voids in the surface of the biomass as the drying assembly is moved 360 degrees around the structure 12.

Based upon information received from the sensors 114, the control system 110 determines when the biomass needs to be stirred. To activate the third mode of operation, or the stirring mode of operation, the control system 110 activates the first motor 50 causing the lift assembly 38 to position the tine assembly 64 so that the tines are inserted into the biomass. Then, the control system 110 activates the second motor 95 to raise the auger assembly 76 using the auger lift assembly 93 if not already in a raised position. The third motor 106 is then activated by the control system 110 to rotate the tine assembly 64 in a concurrent or forward direction wherein the tines 72 engage the biomass and move the biomass backwards behind the shaft 66 while the tines 72 continue upward and over the shaft. Finally, the control system 110 activates the tractor drive assembly 100 to rotate the drying assembly 10 about the first tube 40 in a forward direction. The stirring mode stirs the biomass material, breaking up packed concentrations of material resulting in more uniform distributions of the biomass for more efficient drying. To reduce over stirring, a reduced number of tines 72 are attached to the mounting tube 70.

Once the biomass is dried to a desired moisture level, the control system 110 activates a fourth mode, or unloading mode, of operation. To activate the unloading mode the control system 110 lowers the auger assembly 76 through the activation of the second motor 95 and the auger lift assembly 93. The discharge flaps are then opened 118 and the control system 110 activates the fourth motor 108 which causes the auger 80 to rotate in a concurrent or forward direction. Finally, without activating the third motor 106, the control system 110 activates the tractor drive assembly 100 to cause the drying assembly to rotate about the first tube 40 in a forward direction. The control system also activates the fourth motor 108 to rotate the auger 80 to move the biomass material inward toward the center of the structure in a counter or forward directions where the biomass is moved in front of the auger 80. The auger 80 transports dried biomass material toward the discharge flaps where the material falls through the opening 120 in the drying floor 20 and into the discharge hopper 116.

The tractor drive assembly 100, the third motor 106, and the fourth motor 108, are of any type and in one embodiment the control system 110 includes a Variable Frequency Drive (VFD). The control system 110 is adapted to adjust or change the linear or track speed of the tractor drive assembly 100 and can also move the tractor drive assembly 100 in either a forward or backward direction. The control system 110 also is adapted to vary the direction and rotational speed of the third 106 and the fourth 108 motors.

Accordingly, a hemp biomass drying assembly 10 has been disclosed that at the very least, meets all of the stated objectives. From the above discussion and accompanying figures and claims it will be appreciated that the hemp biomass drying assembly 10 offers many advantages over the prior art. It will be appreciated further by those skilled in the art that other various modification could be made to the device without parting from the spirit and scope of this invention. All such modifications and changes fall within the scope of the claims and are intended to be covered thereby. It should be understood that the examples and embodiments described herein are for illustrative purposes only and that various modifications or changes in the light thereof will be suggested to persons skilled in the art and are to be included in the spirit and purview of this application.

What is claimed is:

1. A hemp biomass drying assembly, comprising:

a structure having a bottom wall and a side wall;

a lift assembly disposed within a center of the structure;

a rotatable tine assembly connected to the lift assembly and extending radially between the center of the structure and the side wall;

an auger assembly connected to the lift assembly and extending radially between the center of the structure and a sidewall;

a track assembly connected to the lift assembly and configured to rotate the tine assembly and the auger assembly about the lift assembly; and the track assembly having a chain track positioned between a pair of spaced rails connected to an inner surface along a perimeter of the side wall.

2. The drying assembly of claim 1 wherein the rotatable tine assembly has multiple modes of operation.

3. The drying assembly of claim 2 wherein the multiple modes of operation include at least a leveling mode and a stirring mode.

4. The drying assembly of claim 2 further comprising the multiple modes of operation having a spreading mode, a levelling mode, a stirring mode, and an unloading mode.

5. The drying assembly of claim 4 wherein when in the spreading mode a biomass material is spread about the structure by:

the lift assembly is lowered to engage the rotatable tine assembly and the auger assembly with the biomass material and rotate the rotatable tine assembly and the auger assembly about the lift assembly in a forward direction;

a tine assembly of the rotatable tine assembly is rotated about the rotatable tine assembly in a rearward direction such that the biomass material is moved in the forward direction;

the auger assembly is rotated to move the biomass material inward and outward toward a center of the structure, wherein the biomass material is moved inward toward the center of the structure by rotation of the auger assembly in a rearward direction and the biomass material is moved outward toward the side wall by the auger assembly in a forward direction; and a tractor assembly rotates the rotatable tine assembly and the auger assembly about the lift assembly.

6. The drying assembly of claim 4 wherein when in the levelling mode a biomass material is levelled by:

the lift assembly is lowered to insert a tine assembly of the rotatable tine assembly partially into the biomass material;

the auger assembly is moved to a raised position to not engage the biomass material;

the rotatable tine assembly is rotated about the rotatable tine assembly to produce a rolling wave of the biomass material ahead of the rotatable tine assembly to fill voids in a surface of the biomass material; and a tractor assembly rotates the rotatable tine assembly about the lift assembly.

7. The drying assembly of claim 4 wherein when in the stirring mode a biomass material is stirred by:

the lift assembly is lowered to insert a tine assembly of the rotatable tine assembly partially into the biomass material;

the auger assembly is moved to a raised position to not engage the biomass material;

the rotatable tine assembly is rotated about the rotatable tine assembly in a forward direction such that the biomass material travels backwards behind the rotatable shaft assembly; and a tractor assembly rotates the rotatable tine assembly about the lift assembly in a forward direction.

8. The drying assembly of claim 4 further comprising a discharge hopper having a discharge flap connected to an elevated plenum drying floor within the structure; and wherein when in the unloading mode a biomass material is unloaded from above the plenum drying floor by:

the lift assembly is lowered to engage the biomass material with the auger assembly;

the discharge flap is transitioned to form an opening in the elevated plenum drying floor;

the auger assembly is rotated about a forward direction such that the biomass material travels inwards toward the opening and into the discharge hopper; and a tractor assembly rotates the auger assembly about the lift assembly in a forward direction.

9. The drying assembly of claim 1 wherein the auger assembly is disposed within the structure and is adapted to rotate about the center of the structure.

10. The drying assembly of claim 9 wherein an auger lift assembly is connected to the auger assembly.

11. The drying assembly of claim 9 wherein the auger assembly includes an auger and an adjustable backboard.

12. The drying assembly of claim 1 wherein disposed within the structure is an elevated plenum drying floor that separates the structure into a plant drying area and a drying air plenum.

13. The drying assembly of claim 12 wherein a drying system is connected to and in communication with the drying air plenum.

14. The drying assembly of claim 1 wherein the rotatable tine assembly has a radial shaft, a mounting tube connected to the shaft, and a plurality of tines connected to the mounting tube.

15. The drying assembly of claim 1 wherein a control system activates and controls the operation of the lift assembly, the rotatable tine assembly, and the auger assembly.

16. The drying assembly of claim 1 further comprising an elevated plenum drying floor configured to separate an interior of the structure into a plant drying area above the elevated plenum drying floor and a drying air plenum below the elevated plenum drying floor such that the drying air plenum is positioned between the elevated plenum drying floor and the bottom wall of the structure.

17. The drying assembly of claim 16 wherein the elevated plenum drying floor is perforated such that the elevated plenum drying floor is configured to hold a biomass material while permitting air to flow from the drying air plenum through the elevated plenum drying floor to the biomass material.

18. The drying assembly of claim 16 wherein the elevated plenum drying floor is positioned in parallel spaced relation to the bottom wall.

19. The drying assembly of claim 16 wherein the drying air plenum is heated.

20. The drying assembly of claim 1 further comprising a drying system having a plurality of sensors and monitors positioned inside and outside of the structure, wherein the plurality of sensors and monitors are configured to monitor an ambient temperature and humidity and a temperature and humidity of a biomass material to determine an airflow to provide a desired temperature and humidity to the biomass to achieve a desired final moisture content of the biomass material.

21. The drying assembly of claim 20 further comprising the drying assembly having a fan and a heater that are in communication with a drying air plenum.

22. The drying assembly of claim 21 further comprising the drying assembly having an air duct configured to communicate an airflow from the fan and the heater to the drying air plenum.

23. The drying assembly of claim 1 further comprising the lift assembly having a first tube that connects to the bottom wall and extends vertically through and above an air drying plenum to a plant drying area.

24. The drying assembly of claim 23 further comprising a second tube slidably and rotatably mounted to the first tube.

25. The drying assembly of claim 24 further comprising an electrical slip ring assembly mounted to the second tube.

26. The drying assembly of claim 25 further comprising a bracket connected to the second tube and the electrical slip ring assembly.

27. The drying assembly of claim 24 further comprising a horizontal support member attached to the second tube.

28. The drying assembly of claim 27 further comprising a support bar bracket attached to the second tube below the horizontal support member.

29. The drying assembly of claim 28 further comprising a pair of vertical support members connected to and extending between the horizontal support member and the support bar bracket.

30. The drying assembly of claim 29 further comprising a pair of support rods connected to the horizontal support member at opposite ends of the horizontal support member, wherein the pair of support rods extend downwardly and outwardly at an angle and connect to a tine support bar and an auger support bar, respectively.

31. The drying assembly of claim 30 further comprising one of the pair of vertical support members connects to the tine support bar and the other of the pair of vertical support members connects to the auger support bar.

32. The drying assembly of claim 23 further comprising a first motor connected to the first tube and configured to operate the lift assembly.

33. The drying assembly of claim 32 wherein the first motor is a jack screw lift.

34. The drying assembly of claim 1 further comprising a pair vertical support members connected to each end, respectively, of a tine support bar of the rotatable tine assembly.

35. The drying assembly of claim 34 further comprising the rotatable tine assembly having a radial shaft rotatably connected to the pair of vertical support members at each end of the radial shaft.

36. The drying assembly of claim 1 further comprising the rotatable tine assembly having a radial shaft connected to a mounting tube having a plurality of tines extending radially from the radial shaft.

37. The drying assembly of claim 36 wherein the plurality of tines are arranged in horizontal rows and the horizontal rows offset the position of the plurality of tines between adjacent horizontal rows.

38. The drying assembly of claim 1 further comprising the auger assembly having an auger.

39. The drying assembly of claim 1 further comprising an auger support bar connected to a plurality of vertical support members, wherein one of the plurality of vertical support members is connected at one end of the auger support bar and another one of the plurality of vertical support members is connected at the other end of the auger support bar.

40. The drying assembly of claim 39 further comprising the auger assembly having a flighting that is rotatably connected to the plurality of vertical support members at each end of the flighting.

41. The drying assembly of claim 39 further comprising at least one of the plurality of vertical support members having a first piece connected to the auger support bar and a second piece pivotally connected to the first piece, wherein the auger assembly is rotatably connected to the second piece.

42. The drying assembly of claim 39 having a backboard support member connected to a second piece of at least one of the plurality of vertical support members, and a backboard attached to a back support member in a position to cover a portion of the auger along a length of the auger, wherein the backboard is configured to prevent a biomass material from being transferred to the opposite side of the auger and direct the conveyance of the biomass material along the length of the auger.

43. The drying assembly of claim 42 further comprising a backboard lift assembly connected to the backboard, wherein the backboard lift assembly is configured to raise and lower the backboard.

44. The drying assembly of claim 43 further comprising the backboard lift assembly having a piston pivotally connected to the backboard and an actuator connected to the piston to raise and lower the piston thereby raising and lowering the backboard.

45. The drying assembly of claim 42 further comprising the backboard comprising a pair of backboards; and a pair of backboard lift assemblies with one of the pair of backboards connected to one of the pair of backboards and another of the pair of backboards connected to the other of the pair of backboards, wherein the pair of backboard lift assemblies are configured to raise the respective backboard depending on a forward direction of the auger assembly.

46. The drying assembly of claim 42 further comprising a rotational member connected to the backboard, wherein the rotational member is configured to adjust the backboard about the auger.

47. The drying assembly of claim 46 further comprising the rotational member having a sprocket positioned to engage a plurality of grooves on an outer surface of the backboard.

48. The drying assembly of claim 1 further comprising an auger lift assembly connected to the auger assembly, wherein the auger lift assembly is configured to raise and lower the auger assembly to adjust the angle and depth of engagement that the auger assembly has with a biomass material including to raise the auger lift assembly to not engage the biomass material.

49. The drying assembly of claim 48 further comprising the auger lift assembly having a piston that extends vertically to a motor that is connected to a vertical support member connected to the auger assembly.

50. The drying assembly of claim 1 further comprising the track assembly having a pair of tractor drive assemblies connected to the chain track on opposing locations about the side wall, wherein the pair of tractor drive assemblies are configured to travel along the chain track to rotate the tine assembly and the auger assembly about the lift assembly.

51. The drying assembly of claim 1 further comprising a first motor connected to the rotatable tine assembly and a second motor connected to the auger assembly, wherein the first motor is configured to drive the direction and speed of the rotation of the rotatable tine assembly and the second motor is configured to drive the direction and speed of the rotation of the auger assembly.

52. A hemp biomass drying assembly, comprising:

a structure having a bottom wall and a side wall;

an elevated plenum drying floor positioned above the bottom wall;

a drying system in communication with the elevated plenum drying floor;

a discharge hopper connected to an opening in the elevated plenum drying floor;

a lift assembly disposed within a center of the structure and extending through the elevated drying plenum;

a rotatable tine assembly connected to the lift assembly and extending radially between the center of the structure and the side wall;

an auger assembly having a backboard and an auger, wherein the auger assembly is connected to the lift assembly and extending radially between the center of the structure and the side wall;

an auger lifting assembly connected to the auger assembly and configured to raise and lower the auger assembly;

a backboard lifting assembly connected to the backboard and configured to adjust the position of the backboard;

a track assembly connected to the rotatable tine assembly and adapted to rotate the rotatable tine assembly and the auger assembly about the center of the structure;

at least one control system configured to operate the auger assembly and the rotatable tine assembly in multiple modes of operation;

a first motor in operative connection with the lift assembly to raise and lower the lift assembly;

a second motor in operative connection with the auger lift assembly to raise and lower the auger assembly;

a third motor in operative connection with the rotatable tine assembly to drive the direction and speed of the rotation of the rotatable tine assembly; and a fourth motor in operative connection with the auger assembly to drive the direction and rotation speed of the auger assembly.

53. The hemp biomass drying assembly of claim 52 further comprising the multiple modes of operation comprising a spreading mode, a levelling mode, a stirring mode, and an unloading mode.

54. The hemp biomass drying assembly of claim 52 further comprising a first control system and a second control system each having a plurality of monitors to monitor a temperature and humidity of a biomass material, wherein the first control system and the second control system are configured to modify the position of the biomass material within the structure and an airflow entering the structure.

55. A hemp biomass drying assembly, comprising:

a structure having a bottom wall and a side wall;

a lift assembly disposed within a center of the structure;

a rotatable tine assembly connected to the lift assembly and extending radially between the center of the structure and the side wall; and an auger assembly connected to the lift assembly and extending radially between the center of the structure and a sidewall;

the lift assembly having a first tube that connects to the bottom wall and extends vertically through and above an air drying plenum to a plant drying area;

a second tube slidably and rotatably mounted to the first tube; and an electrical slip ring assembly mounted to the second tube.

56. A hemp biomass drying assembly, comprising:

a structure having a bottom wall and a side wall;

a lift assembly disposed within a center of the structure;

a rotatable tine assembly connected to the lift assembly and extending radially between the center of the structure and the side wall;

an auger assembly connected to the lift assembly and extending radially between the center of the structure and a sidewall;

the lift assembly having a first tube that connects to the bottom wall and extends vertically through and above an air drying plenum to a plant drying area;

a second tube slidably and rotatably mounted to the first tube;

a horizontal support member attached to the second tube;

a support bar bracket attached to the second tube below the horizontal support member; and a pair of vertical support members connected to and extending between the horizontal support member and the support bar bracket.

57. A hemp biomass drying assembly, comprising:

a structure having a bottom wall and a side wall;

a lift assembly disposed within a center of the structure;

a rotatable tine assembly connected to the lift assembly and extending radially between the center of the structure and the side wall;

an auger assembly connected to the lift assembly and extending radially between the center of the structure and a sidewall; and a pair vertical support members connected to each end, respectively, of a tine support bar of the rotatable tine assembly.

58. A hemp biomass drying assembly, comprising:

a structure having a bottom wall and a side wall;

a lift assembly disposed within a center of the structure;

a rotatable tine assembly connected to the lift assembly and extending radially between the center of the structure and the side wall;

an auger assembly connected to the lift assembly and extending radially between the center of the structure and a sidewall;

an auger support bar connected to a plurality of vertical support members, wherein one of the plurality of vertical support members is connected at one end of the auger support bar and another one of the plurality of vertical support members is connected at the other end of the auger support bar;

a backboard support member connected to a second piece of at least one of the plurality of vertical support members, and a backboard attached to a back support member in a position to cover a portion of the auger along a length of the auger, wherein the backboard is configured to prevent a biomass material from being transferred to the opposite side of the auger and direct the conveyance of the biomass material along the length of the auger;

the backboard comprising a pair of backboards; and a pair of backboard lift assemblies with one of the pair of backboards connected to one of the pair of backboards and another of the pair of backboards connected to the other of the pair of backboards;

wherein the pair of backboard lift assemblies are configured to raise the respective backboard depending on a forward direction of the auger assembly.

59. A hemp biomass drying assembly, comprising:

a structure having a bottom wall and a side wall;

a lift assembly disposed within a center of the structure;

a rotatable tine assembly connected to the lift assembly and extending radially between the center of the structure and the side wall;

an auger assembly connected to the lift assembly and extending radially between the center of the structure and a sidewall;

an auger support bar connected to a plurality of vertical support members, wherein one of the plurality of vertical support members is connected at one end of the auger support bar and another one of the plurality of vertical support members is connected at the other end of the auger support bar;

a backboard support member connected to a second piece of at least one of the plurality of vertical support members, and a backboard attached to a back support member in a position to cover a portion of the auger along a length of the auger, wherein the backboard is configured to prevent a biomass material from being transferred to the opposite side of the auger and direct the conveyance of the biomass material along the length of the auger;

a rotational member connected to the backboard, wherein the rotational member is configured to adjust the backboard about the auger; and the rotational member having a sprocket positioned to engage a plurality of grooves on an outer surface of the backboard.

* * * * *